US007288317B2

(12) United States Patent
Poulin et al.

(10) Patent No.: US 7,288,317 B2
(45) Date of Patent: Oct. 30, 2007

(54) COMPOSITE FIBRE REFORMING METHOD AND USES

(75) Inventors: Philippe Poulin, Caluire (FR); Pascale Launois, Palaiseau (FR); Brigitte Vigolo, Bordeaux (FR); Patric Bernier, Castries (FR)

(73) Assignee: Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 10/486,321

(22) PCT Filed: Aug. 5, 2002

(86) PCT No.: PCT/FR02/02804

§ 371 (c)(1),
(2), (4) Date: Feb. 9, 2004

(87) PCT Pub. No.: WO03/014431

PCT Pub. Date: Feb. 20, 2003

(65) Prior Publication Data

US 2004/0177451 A1 Sep. 16, 2004

(30) Foreign Application Priority Data

Aug. 8, 2001 (FR) ..... 01 10611

(51) Int. Cl.
*D02G 3/00* (2006.01)
*B29C 47/00* (2006.01)

(52) U.S. Cl. ..... 428/370; 428/373; 428/374; 428/372; 264/119

(58) Field of Classification Search ..... 428/370, 428/373, 372, 374; 429/249, 247; 264/119
See application file for complete search history.

(56) References Cited

U.S. PATENT DOCUMENTS

| | | | | |
|---|---|---|---|---|
| 6,124,058 | A * | 9/2000 | Ohmory et al. | 429/247 |
| 6,589,643 | B2 * | 7/2003 | Okada et al. | 428/297.4 |
| 6,699,708 | B1 * | 3/2004 | Muller et al. | 435/262 |
| 6,743,859 | B2 | 6/2004 | Kowaka et al. | |

OTHER PUBLICATIONS

Zhou, W.; Vavro, Jr.; Guthy, C.; Winey, K.I.; and Fischer, J.E.; "Single Wall Carbon Nanotube Fibers Extruded from Super-Acid Suspensions: Preferred Orientation, Electrical, and Thermal Transport "; Journal of Applied Physics; vol. 95, No. 2; 649-655; Jan. 15, 2004.

Hwang, J.; Gommans, H. H.; Ugawa, A.; Tashiro, H.; Haggenmueller, R.; Winey, K. I.; Fischer, J. E.; Tanner, D. B.; and Rinzler, A. G.; "Polarized Spectroscopy of Aligned Single-Wall Carbon Nanotubes"; Physical Review B vol. 62, No. 20; 4 pp.; Nov. 15, 2000.

(Continued)

*Primary Examiner*—N. Edwards
(74) *Attorney, Agent, or Firm*—Conley Rose, P.C.

(57) ABSTRACT

The invention concerns a method for reforming composite fibres comprising colloidal particles and at least a binding and/or crosslinking polymer, characterised in that it comprises: means for deforming, by cold process at room temperature or at a temperature slightly higher than room temperature, said polymer of said fibre, and means for applying, on said fibre, mechanical stresses.

20 Claims, 1 Drawing Sheet

OTHER PUBLICATIONS

Figure 1:
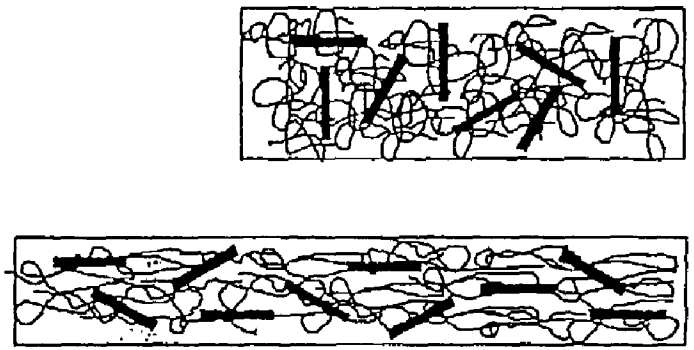

Fischer, J. E.; Zhous, W.; Vavro, J.; Llaguno, M. C.; Guthy, C.; Haggenmueller, R.; Casavant, J. J.; Walters, D. E.; and Smalley, R. E.; "Magnetically Aligned Single Wall Carbon Nanotube Films: Preferred Orientation and Anisotropic Transport Properties"; Journal of Applied Physics; vol. 93, No. 4; 2157-2163; Feb. 15, 2003.
Du, Fangming; Fischer, John E.; Winey, Karin I.; "Coagulation Method for Preparing Single-Walled Carbon Nanotube/Polymethyl methacrylate) Composites and Their Modulus, Electrical Conductivity, and Thermal Stability", Journal of Polymer Science, Part B: Polymer Physics, vol. 41, 3333-3338; Jul. 21, 2003.
Badaire, Stephane; Pichot, Vincent; Zakri, Cecile; Poulin, Philipe; Launois, Pascale; Vavro, Juraj; Guthy, Csaba; Chen, Michelle; and Fischer, John E.; "Correlation of Properties With Preferred Orientation in Coagulated and Stretch-Aligned Single-Wall Carbon Nanotubes"; Journal of Applies Physics; vol. 96, No. 12; 7509-7513; Dec. 15, 2004.

* cited by examiner

COMPOSITE FIBRE REFORMING METHOD AND USES

The present invention relates generally to the post-treatment of composite fibres and in particular a new process for reforming composite fibres comprising colloidal particles and at least one binding and/or bridging polymer, the use of the process and the reformed fibres obtained by said process.

By colloidal particles is meant within the meaning of the invention the particles defined according to the international standards of the IUPAC as being particles the size of which is comprised between a few nanometres and a few micrometres.

It is known that generally, the properties of composite fibres critically depend on the structure and arrangement of their components and in particular on the particles which compose them. The main parameters which will then govern the properties of the fibre are the entanglement of the particles, their orientation and finally the intensity of any cohesive forces between the particles.

As in standard textile fibres, the entanglement can be modified by twisting the fibre more or less and, as in the case of the standard polymer fibres, the orientation of the particles must be able to be modified by exerting traction on the fibre, which can be produced, for example, by an extrusion process. In a standard fashion, for such polymer fibres, these alignments or orientations are obtained in the hot state. In fact, at a high temperature, the fibre becomes deformable and the more mobile polymer chains can then be oriented by the traction exerted on the fibres.

These structural or reforming modifications require the fibre to be sufficiently deformable, but however fairly resistant in order to undergo mechanical actions under straightforward conditions. In the case of composite fibres comprising colloidal particles and at least one binding and/or bridging polymer, in general the known processes for reforming fibres in the hot state are used. These methods therefore require working at least at the polymer's glass transition temperature, in order to make it flexible and increase the possibilities of movement of the particles in/with the polymer. It follows that there is a considerable energy consumption and special equipment making it possible to work at these temperatures which are in general sufficiently high to encourage oxidations. Moreover, these rises in temperature can cause a degradation, albeit tiny, of the polymer or particles constituting said fibre, chiefly by oxidation of the constituents of the polymer or particles, a degradation which can in the long term prove detrimental to the behaviour of the fibre and its cohesion. This degradation is proportional to the duration of the treatment and is a function of the different terminal chemical groups of the polymer and of the particle constituents.

The invention therefore proposes remedying these drawbacks by providing a process for reforming composite fibres comprising colloidal particles and at least one binding and/or bridging polymer, which is particularly straightforward to implement, requiring little or no energy, retaining the integrity of all the fibre's constituents and not requiring the installation of special equipment.

To this end and according to the invention, a process for reforming composite fibres comprising colloidal particles and at least one binding and/or bridging polymer comprises:

means for deforming, in the cold state, at ambient temperature, or at a temperature slightly above ambient temperature, said polymer of said fibre, and means of applying, to said fibre, mechanical stresses.

In fact, the inventors have discovered, what is the subject of the invention, that these composite fibres comprising colloidal particles and at least one binding and/or bridging polymer could perfectly well be treated "in the cold state" or also at ambient temperature or even slightly above ambient temperature by the use of simple means of deformation of said bridging and/or binding polymer.

By reforming in the cold state, at ambient temperature or at a temperature slightly above ambient temperature is meant any treatment of the fibres used in said process at a temperature ranging from 0° C. to a temperature slightly above ambient temperature, the latter being generally considered as being of the order of 20 to 25° C. Higher temperatures are advantageously comprised between 25° C. and 50° C.

Preferentially, said means for deforming said polymer are constituted by the addition of plasticizer.

In fact, the majority of the polymers have affinities for certain plasticizers used in the cold state which allows their conformation to be made more flexible.

Another possibility for deformation of these polymers consists of immersion of said fibre in a solvent or a mixture of solvents such that the reciprocal solubility of said polymer in said solvent or said mixture of solvents affects the optimization of said mechanical stresses applied.

Advantageously, and according to the mechanical stresses to which the fibre is to be subjected, said solvent is chosen from the solvents in which the polymer is soluble or partially soluble.

The fibre is then made flexible by partial solubilization of the polymer and therefore becomes easily malleable and transformable.

According to another method of implementation of the process, said solvent is chosen from the solvents in which the polymer is insoluble or practically insoluble.

In fact, if the fibre is to be subjected to considerable stresses without the risk of its breaking or deteriorating in a definitive manner, it is desirable not to completely dissolve said polymer but simply to partially solvate it in order to confer upon it a certain flexibility and therefore to allow the application of mechanical stresses, while maintaining its cohesion.

In fact, one of the advantages of the process according to the invention is that the salvation of a composite fibre comprising particles and at least one binding and/or bridging polymer allows the movement of the particles with respect to one other without destroying the cohesion of the binding and/or bridging polymer due to the fact of the bridging forces existing between the polymer and the particles.

A standard fibre constituted by particles in a polymer matrix subjected to the process according to the invention would lead to the complete dissolution of the polymer and therefore to destruction of the fibre.

Of course, the process can be implemented by choosing as solvent all the volume and/or weight mixtures of at least one solvent in which the polymer is soluble or partially soluble and at least one solvent in which the polymer is insoluble or practically insoluble.

Thus, a whole range of deformation is then obtained, allowing the use of a corresponding stress range as a function of the desired properties of the final fibre.

Advantageously, said solvent can contain at least one cross-linking agent.

In fact, said polymer being able to be particularly soluble in certain solvents, the addition of a cross-linking agent will lead to the hardening of said polymer while avoiding the sliding without reorientation of said colloidal particles which may occur if said polymer is rendered too plastic since the polymer does not play the role of matrix here but is by definition binding and/or bridging between the particles. This results in a stiffening of said polymer which then allows better transmission of the mechanical stresses applied to the fibre and incidentally to the colloidal particles the reorientation of which inside said fibre is desired. These cross-linking agents will, of course, be chosen as a function of the nature of said polymer and that of said solvent. They can for example be salts or organic compounds.

Preferentially and as a function of the polymer, the solvents used for the implementation of the process according to the invention are chosen from water, acetone, ethers, dimethylformamide, tetrahydrofuran, chloroform, toluene, ethanol, and/or aqueous solutions the pH and/or the concentrations of any solutes of which are controlled.

Preferably, said polymer is chosen from the polymers being adsorbed on said colloidal particles.

For example, the binding and/or bridging polymers according to the invention are chosen from polyvinylalcohol, the flocculating polymers commonly used in the liquid effluent pollution control industry, such as polyacrylamides, which are neutral polymers, acrylamide and acrylic acid copolymers, which are negatively charged, acrylamide and cationic monomer copolymers, which are positively charged, aluminium-based inorganic polymers, and/or natural polymers such as chitosan, guar and/or starch.

It is also possible to choose as polymer a mixture of polymers which are chemically identical but differ from one another by their molecular mass.

Preferentially, said polymer is polyvinylalcohol (PVA), commonly used during the synthesis of composite fibres comprising particles and at least one binding and/or bridging polymer.

More particularly also, said polymer is polyvinylalcohol of molar mass comprised between 10,000 and 200,000.

In the case of polyvinylalcohol, an example of a choice of solvents can be the following: water, in which the PVA is soluble, acetone in which the PVA is insoluble or a mixture of water and acetone in which the PVA will have a controlled solubility.

Still in the case of polyvinylalcohol, the borates constitute an example of cross-linking agents which can be used during the immersion of the fibre in the water.

In a manner known per se in the field of the post-treatment of the fibres, the mechanical stresses are torsional and/or tractive.

Preferentially, the colloidal particles are chosen from carbon nanotubes, tungsten sulphide, boron nitride, clay platelets, cellulose whiskers and/or silicon carbide whiskers.

In standard manner, the process can comprise additional stages of extraction of said fibre out of the solvent and/or drying of said fibre in order to obtain a fibre devoid of any plasticizer and/or any trace of solvent. These operations can advantageously be carried out in a known manner such as, for example, drying in an oven at a temperature slightly below the solvent's boiling temperature.

The process which is the subject of the invention can be used in order to produce fibres having an orientation of said particles composing said fibre mostly in the direction of the principal axis of said fibre.

The process which is the subject of the invention can also be used in order to produce fibres having an increased length and/or a reduced diameter with respect to the original fibre.

Finally, the process which is the subject of the invention can be used in order to produce fibres made denser and/or finer with respect to the original fibre.

Figure 2:
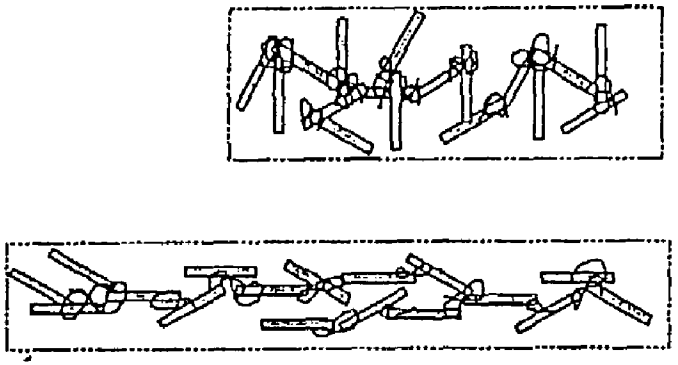

Other characteristics and advantages of the present invention will become apparent from the description given hereafter, with reference to the drawing which illustrates an example of implementation of the process according to the invention, without having any limitative character. In the drawing:

FIG. 1 represents sections of fibres comprising particles and a polymer used as matrix before and after stretching in the hot state, and FIG. 2 represents sections of fibres comprising colloidal particles and a polymer bridging between the particles before and after implementation of the process according to the invention.

In the example described hereafter, carbon nanotube fibres are used in order to prove the effectiveness and the advantages of the process according to the invention.

These fibres are advantageously produced according to the process of the Patent Application FR 00 02 272 in the name of the CNRS. This process comprises the dispersion in a homogeneous fashion of the nanotubes in a liquid medium. The dispersion can be carried out in water using surfactants which are adsorbed at the interface of the nanotubes. Once dispersed, the nanotubes can be recondensed in the form of a sliver or prefibre by injecting the dispersion into another liquid which causes the destabilization of the nanotubes. This liquid can be for example a solution of polymers. The flows used can be modified in order to encourage the alignment of the nanotubes in the prefibre or sliver. Moreover, the throughputs and flow speeds also make it possible to control the section of the prefibres or slivers.

The prefibres or slivers thus formed may or may not then be washed with rinsings which allow certain adsorbed species to be desorbed (polymers or surfactants in particular). The prefibres or the slivers can be produced in a continuous fashion and extracted from their solvent in order to be dried. Dry fibres of carbon nanotubes which can easily be manipulated are then obtained.

The process for obtaining these fibres is known to leave traces of polymer, in general polyvinylalcohol (PVA) as residual polymer. The cohesion of the fibre is not directly ensured by the rigidity of the polymer, but by its adsorption on neighbouring carbon nanotubes, i.e. by the phenomenon known by the name of bridging.

The drying in the initial production of the fibre leads to considerable modifications which disturb the alignment of the carbon nanotubes and, whatever the method for obtaining these fibres, the latter show little or no difference in orientation of the carbon nanotubes.

In order to improve the orientation, it is necessary to reform the fibre in a later stage by the mechanical actions previously described in the implementation of the process.

In particular, the fibre is solvated in a given solvent in order to subject it to torsion and/or traction.

As FIG. 1 shows, in the known processes, a polymer fibre can be oriented by simple extrusion or drawing in the hot state. If the fibre contains particles such as carbon nanotubes or whiskers, the latter are also oriented. The polymer then plays the role of matrix and it is the deformation of this support which leads to the modifications of fibre structures.

As FIG. 2 shows, and according to the implementation of the process according to the invention, the colloidal particles are directly interlinked to one another. The cohesion of the structure no longer comes from the polymer itself, but directly from the particles which are linked by a bridging polymer. The structure of the fibre can be modified by traction or torsion, if the binding polymer is plastic, or rendered deformable by salvation.

For example, for a fibre constituted by carbon nanotubes and the bridging polymer of which is PVA, such an implementation is carried out at ambient temperature by simply soaking the fibre in water or in another solvent having a certain affinity for PVA.

Other solvents, such as acetone, in which PVA is not soluble can also be used.

By way of example, a table is given showing the results obtained during the subjection to different tractive forces of carbon nanotube fibres obtained with different PVAs and for a range of solvents comprised between the two extremes constituted by water and acetone.

The fibres used are obtained according to the process mentioned and comprising:

the dispersion of nanotubes (0.4% by mass) in an aqueous solution of SDS (1.1% by mass), the injection of the dispersion of nanotubes at a throughput of 100 ml/h through a 0.5 mm orifice in a flow of a solution of PVA at a speed of 6.3 m/min. Two types of PVA are used, one with a mass of 50,000 and one with a mass of 100,000 grams.

The sliver is then rinsed in pure water several times and extracted from the water in order to form a dry thread.

In this implementation of the process according to the invention, water is qualified as a good solvent and acetone as a poor solvent.

The other major parameters correspond to the characteristics of the fibres and carbon nanotubes. As is known in the textile industry, for example, these parameters are critical for the final properties of a thread composed of smaller fibres. The problem here is identical insofar as the thread is constituted by carbon nanotubes.

The structural modifications are characterized by measurements of extensions and by X-ray diffraction experiments which quantitatively produce the average orientation of the carbon nanotubes.

In the table hereafter, the examples of carbon nanotube fibres have been obtained by the same process using the same implementation parameters with two PVAs of different molar weights, the first having a molar weight of 50,000, the second a molar weight of 100,000.

The fibres thus obtained are then immersed in a solvent and subjected to tractive forces which are expressed in grams. The tractive forces are produced by connecting well-defined masses to the fibres. The fibres are then extracted from the solvent and thus dried under tension. The dry fibres are recovered and their structure characterized.

The carbon nanotubes in the fibres are organized in bundles and form a hexagonal network perpendicular to the axis of the fibre. The alignment of the carbon nanotube bundles with respect to the axis of the fibre can be characterized by the full-width at half-maximum (FWHM) of the angular dispersion at constant wave vector on a Bragg peak of the hexagonal network (Gaussian adjustment) or by the value of the intensity diffracted along the axis of the fibre, i.e. by carbon nanotubes perpendicular to this axis.

The table hereafter shows the results obtained for the alignment of the carbon nanotubes according to the molar mass of the PVA, the solvent used and the traction exerted on the fibre.

| PVA | Solvent | Traction | Extension | FWHM |
|---|---|---|---|---|
| 50K | Water | 0 | 0 | 80-90° |
| 50K | Water | 0.15 g | 21% | 70° |

-continued

| PVA | Solvent | Traction | Extension | FWHM |
|---|---|---|---|---|
| 50K | 70 water/30 acetone | 0.28 g | 22% | 60-65° |
| 50K | 50 water/50 acetone | 0.65 g | 23% | 55-60° |
| 100K | water | 0.15 g | 9% | 70-75° |
| 100K | water | 0.28 g | 16% | 65° |
| 100K | water | 0.44 g | 25% | 60° |
| 100K | water | 0.65 g | 36% | 60° |

It is noted that the better the solvent is for the PVA, the more easily deformable the solvated fibre.

On the other hand, a poor solvent makes it possible to apply greater stresses with smaller or equivalent deformations. The coupling of the quality of the solvent with the nature of the polymer is therefore a parameter which makes it possible to optimize both the mechanical stresses to be imposed and the desired deformations.

The higher the mass of the polymer, the more resistant the solvated fibre is and therefore it can be subjected to greater stresses without breaking or deteriorating and its modulus of elasticity is higher.

The predominant role of the binding and/or bridging polymer is thus particularly emphasized in obtaining optimized mechanical properties for the solvated fibre. In particular, it is the strong adsorption of the polymer on the particles and the significant bridging which is carried out on the particles which is brought into play here.

Of course, it is also noted that the greater the traction applied, the greater the extension obtained.

On the other hand, the greater the extension, the better the alignment of the carbon nanotubes.

It is also noted that at a constant extension, the alignment is better for good solvent—poor solvent mixtures than for the good solvent used alone.

The solvated fibres support strong torsions without breaking, up to more than a hundred turns per centimetre.

These torsions allow the fibres to be made finer and denser.

The nanotube carbon fibres are thus deformable and reformable by a simple treatment in the cold state. These deformations, and the implementation of the process which is the subject of the invention make it possible to control the arrangement of the nanotubes by the combination of the numerous alterable variable parameters such as torsion, tension, the quality of the solvent, the nature and mass of the polymer and the geometric characteristics of the fibres and of the slivers used for the reforming.

A fibre, directly following its manufacture, will have a minimum FWHM of 80°, whilst after reforming according to an implementation of the process according to the invention, the fibre will have an FWHM below 80° and therefore an angular dispersion comprised between +40° and −40°.

The physical properties of the composite fibres comprising colloidal particles and at least one binding and/or bridging polymer are therefore significantly improved. They thus become more effective for all the uses for which they can be intended such as making high-resistance cables, light conducting wires, chemical detectors, force and mechanical stress or sound sensors, electromechanical actuators and artificial muscles, the production of composite materials, nanocomposites, electrodes and microelectrodes for example.

It remains to be said of course that the present invention is not limited to the embodiments described or represented above, but that it encompasses all variants.

The invention claimed is:

1. A process for providing reformed composite fibres, comprising:

providing composite fibres comprising colloidal particles and at least one binding and/or bridging polymer;

deforming the polymer in the composite fibres at a temperature between 0° C. and 50° C., wherein deforming the polymer in the composite fibres comprises adding a plasticizer or immersing the composite fibres in a solvent or a mixture of solvents; and applying, to the fibres, mechanical stresses at a temperature between 0° C. and 50° C. to provide reformed composite fibres, wherein the FWHM of the reformed composite fibres is below 80 degrees.

2. The process according to claim 1, wherein deforming said polymer comprises addition of a plasticizer.

3. The process according to claim 1, wherein that the reciprocal solubility of said polymer in said solvent or said mixture of solvents affects the optimization of said mechanical stresses applied.

4. The process according to claim 1, wherein said solvent comprises solvents in which the polymer is soluble or partially soluble.

5. The process according to claim 1, wherein said solvent comprises solvents in which the polymer is insoluble or practically insoluble.

6. The process according to claim 1, wherein said solvent comprises a mixture, wherein the mixture comprises at least one solvent in which the polymer is soluble or partially soluble and at least one solvent in which the polymer is insoluble or practically insoluble.

7. The process according to claim 1, wherein said solvent contains at least one cross-linking agent.

8. The process according to claim 1, wherein said solvent comprises water, acetone, the ethers, dimethylformamide, tetrahydrofuran, chloroform, toluene, ethanol, and/or aqueous solutions the pH and/or the concentrations of any solutes of which are controlled.

9. The process according to claim 1, wherein said polymer is adsorbed on said colloidal particles.

10. The process according to claim 9, wherein said polymer comprises polyvinyl alcohol, the flocculating polymers commonly used in the liquid effluent pollution control industry, such as polyacrylamides, which are neutral polymers, acrylamide and acrylic acid copolymers, which are negatively charged, acrylamide and cationic monomer copolymers, which are positively charged, aluminium-based inorganic polymers, and/or natural polymers such as ehitosan, guar and/or starch.

11. The process according to claim 10, wherein said polymer is polyvinylalcohol (PVA) with a molar mass comprised between 10,000 and 200,000.

12. The process according to claim 11, wherein said solvent comprises water, acetone or a mixture of water and acetone.

13. The process according to claim 1, wherein the mechanical stresses are torsional and/or tractive.

14. The process according to claim 1, wherein said particles comprise carbon nanotubes, tungsten suiphide, boron nitride, clay platelets, cellulose whiskers and/or silicon carbide whiskers.

15. The process according to claim 1, further comprising extracting said fibre and/or drying of said fibre.

16. The process according to claim 1, further comprising producing fibres having an orientation of said particles composing said fibre mostly in the direction of the principal axis of said fibre.

17. The process according to claim 1, further comprising producing fibres having an increased length and/or a reduced diameter wit respect to the original fibre.

18. The process according to claim 1, further comprising producing fibres made denser and/or finer.

19. A composite fibre comprising colloidal particles and at least one binding and/or bridging polymer, wherein the FWHM of said fibre is below 80°.

20. The fibre according to claim 19, wherein the angular dispersion of said colloidal particles is comprised between +40° and −40°.

* * * * *